US005833874A

United States Patent [19]

Stewart et al.

[11] Patent Number: 5,833,874

[45] Date of Patent: Nov. 10, 1998

[54] FIRE EXTINGUISHING GELS AND METHODS OF PREPARATION AND USE THEREOF

[75] Inventors: Harry E. Stewart, Malvern; Donald B. MacElwee, Wayne, both of Pa.

[73] Assignee: Powsus Inc., Malvern, Pa.

[21] Appl. No.: 567,631

[22] Filed: Dec. 5, 1995

[51] Int. Cl.[6] ..... A62D 1/08; A62D 1/04

[52] U.S. Cl. ..... 252/8; 252/3; 252/8.05; 169/11; 169/44; 169/46

[58] Field of Search ..... 252/8, 3, 8.05; 169/11, 44, 46

[56] References Cited

U.S. PATENT DOCUMENTS

| | | | |
|---|---|---|---|
| 3,755,163 | 8/1973 | Broll et al. | 252/7 |
| 4,089,804 | 5/1978 | Falk | 252/355 |
| 4,090,967 | 5/1978 | Falk | 252/3 |
| 4,234,432 | 11/1980 | Tarpley, Jr. | 252/8 |
| 4,459,213 | 7/1984 | Uchida et al. | 252/8.05 |
| 4,652,383 | 3/1987 | Tarpley, Jr. et al. | 252/8 |
| 4,806,276 | 2/1989 | Maier | 252/570 |
| 5,053,148 | 10/1991 | von Bonin | 252/8.05 |
| 5,055,208 | 10/1991 | Stewart et al. | 252/8 |
| 5,085,786 | 2/1992 | Alm et al. | 252/8.05 |
| 5,135,054 | 8/1992 | Nimitz et al. | 169/46 |
| 5,196,137 | 3/1993 | Merchant | 252/172 |
| 5,218,021 | 6/1993 | Clark et al. | 524/56 |
| 5,219,474 | 6/1993 | Song et al. | 252/8 |
| 5,466,386 | 11/1995 | Stewart et al. | 252/2 |

*Primary Examiner*—Joseph K. McKane
*Assistant Examiner*—Deanna Baxam
*Attorney, Agent, or Firm*—Kane, Dalsimer, Sullivan, Kurucz, Levy, Eisele and Richard

[57] ABSTRACT

Fire-extinguishing compositions of low ozone depletion potential comprise dry particles of fire-extinguishing agents dispersed in a gel of liquified volatile perfluorocarbons, chlorofluorocarbons or hydrofluorocarbons. The dry particles are compatibilized with the carrier gel by the presence of a surfactant system composed of a non-ionic surfactant, a film forming fluorocarbon surfactant and a phosphorus containing antiflocculent.

22 Claims, No Drawings

FIRE EXTINGUISHING GELS AND METHODS OF PREPARATION AND USE THEREOF

BACKGROUND OF THE INVENTION

1. Field of the Invention

The invention relates to fire-extinguishing gel compositions useful in extinguishing Class A, Class B, Class C and Class D fires.

2. Brief Description of the Related Art

The literature is replete with descriptions of fire-extinguishing compositions. Included in such compositions are gelled compositions comprising dry solid chemicals for extinguishing flames and inhibiting oxidation (for example sodium and potassium bicarbonate) and vaporizing organic liquids like brominated hydrocarbons. The latter compounds also extinguish flames very effectively. The mechanism by which brominated hydrocarbons extinguish flames is two-fold. The primary mechanism involves the termination of free radical reactions that sustain combustion and a secondary mechanism is heat abstraction associated with a high vapor heat capacity and a high heat of vaporization.

A study by the Purdue Research Foundation (Final Report on Fire Extinguishing Agents, Purdue Research Foundation and Dept. of Chemistry with Army Engineers Research and Development Labs., Fort Belvoir, 1950) established at that time as a standard for effectiveness in flame extinguishing, the brominated hydrocarbon bromotrifluoromethane (HALON 1301; the "HALON" system of nomenclature was devised by the Army Corps. of Engineers to identify halogenated hydrocarbons by the numbers of carbon, fluorine, chlorine, bromine and iodine atoms). The study also established HALON 1301 as the least toxic of the brominated hydrocarbon organic liquids for flame extinguishing. The Purdue Research Foundation Report led to the extensive use of HALON 1301 and HALON 1211 (bromochlorodifluoromethane) bromofluorocarbons as volatile, vaporizing organic liquids in flame extinguishing. Unfortunately, the bromofluorocarbons have the potential for destroying ozone in the upper stratosphere, when released into the environment. This impact on the environment has been of great concern.

Subsequently, some 90 countries participated in a treaty to phase out use of the ozone-destroying bromofluorocarbons such as those widely used in commercial applications, including as fire extinguishers. Thus, there is a need for products to replace especially HALON 1301 and HALON 1211. Such products must have acceptable low toxicity, environmental acceptance and comparative performance on a weight/weight or volume/volume basis.

A number of perfluorocarbons, chlorofluorocarbons (CFC) and hydrofluorocarbons (HFC) by themselves have been identified as potentially useful to extinguish fires in flooding applications, and being free of bromine content or low in chlorine content, have little or no ozone depletion potential (ODP). Representative of these perfluorocarbons, chlorofluorocarbons and hydrofluorocarbons are 2-chloro-1,1,1,2-tetrafluoroethane, pentafluoroethane, 1,1,2,2-tetrafluoroethane, 1,1,1,2-tetrafluoroethane, 1,1,1-trifluoroethane, perfluorocyclopropane, perfluoropropane, perfluorocyclobutane and the like; see U.S. Pat. No. 5,135,054, which is incorporated herein by reference thereto. The chlorofluorocarbon compounds are also referred to by the "CFC" system of nomenclature, and the hydrofluorocarbons by the "HFC" system. Under these systems, the first digit represents the number of carbon atoms minus one (and is omitted if zero); the second digit represents the number of hydrogen atoms plus one; and the third digit represents the number of fluorine atoms, For example, HFC-125 represents pentafluoroethane.

However, the low ozone depletion potential substitutes described above and in U.S. Pat. No. 5,135,054 have not, in general, been as effective as the ozone-destroying bromofluorocarbons, particularly in regard to their use in forming stable gels as carriers for dry powder chemicals, especially in streaming applications (where the agent is applied from extinguishers which direct a stream of the agent on the fire site). Streaming compositions, particularly those which are carried in non-aqueous gels, tend to clog in the dispenser nozzle and are difficult to maintain in homogeneous dispersions before dispensing.

Although it was known that tetrafluoroethane was a flame inhibitor (see U.S. Pat. No. 4,459,213, Col. 2, line 61) its use in flame extinction has not been exploited. This is understandable, when one considers that the gas has a high potential for toxicity, being decomposed by high temperatures (open flames, glowing metal surfaces) to form the hazardous compounds hydrofluoric acid and carbonyl fluoride. It is also incompatible with alkaline earth metals, powdered aluminum , zinc, beryllium and the like. Furthermore, initial tests of 1,1,1,2-tetrafluoroethane indicated that as a flame inhibitor the gas per se was no more effective than bromotrifluoromethane; see the U.S. Pat. No. 5,135,054.

We have now discovered that 1,1,1,2-tetrafluoroethane and other hydrofluorocarbons, iodofluorocarbons and chlorofluorocarbons of low ODP can be compounded with certain dry chemicals, in a substantially non-aqueous gel to enhance their covering of exposed flaming or flammable surfaces to enhance its effectiveness. The compositions of the invention are hybrids, i.e., gelled formulations of dry powder agents delivered in liquified hydrofluorocarbons and chlorofluorocarbons. These compositions extinguish flame so rapidly that decomposition of the gas component to undesired toxic products of burning is minimal. In tests, sampling for decomposition products showed no significant formation of HF or $COF_2$.

The compositions of the invention are stable dispersions of low ozone depletion potential and are highly effective in extinguishing Class B and C fires. Some are also useful to extinguish Class A and Class D fires as defined by the National Board of Fire Underwriters. They are effective when applied in both "streaming" and "flooding" applications.

SUMMARY OF THE INVENTION

The invention comprises a substantially non-aqueous, flame-extinguishing gel composition of low ozone depletion potential, which comprises;

a plurality of particles of a dry powder fire-extinguishing agent, dispersed in a gel, comprised of:

a liquefied fire-extinguishing gas of low ozone depletion potential;

a hydrophilic, non-ionic surfactant;

a film-forming fluorocarbon surfactant; and an anti-flocculent proportion of a phosphorus containing antiflocculent.

The invention also comprises the use of the compositions of the invention to extinguish fires.

The term "low ozone depletion potential" (ODP) as used herein means a value of less than about 0.5 as determined by the method of Fisher et al., Nature, Vol. 344, pages 508–512 (Apr. 5, 1990).

DETAILED DESCRIPTION OF THE PREFERRED EMBODIMENTS OF THE INVENTION

Dry powder fire-extinguishing agents are represented by ammonium sulfate, sodium carbonate, potassium carbonate, sodium bicarbonate, potassium bicarbonate, ammonium borate, potassium borate, sodium borate (borax), sodium sulfate, sodium phosphate, sodium polyphosphate, sodium chloride, potassium chloride, ammonium bromide, mono- and diammonium phosphate and the like. Preferred dry powder fire-extinguishing agents are solid forms of the ammonium and sodium salts of polyphosphoric acids (ammonium or sodium polyphosphate). The ammonium polyphosphate solid particles are preferred dry chemical agents for practice of the present invention, since they are inherently polyanions which repel each other, avoiding self-agglomeration. Advantageously, the ammonium polyphosphate solid particles employed in the preferred compositions and method of the invention are prepared by methods well-known in the art, for example, by heat treating phosphates such as urea phosphate with a combined ammoniating and condensing agent such as urea or melamine. Further details of the commercial preparation of ammonium polyphosphates may be found in U.S. Pat. Nos. 3,755,163 and 3,775,315, both incorporated herein by reference thereto. These ammonium polyphosphates are compounds containing a P—O—P type linkage, having the general formula:

$$(NH_4)_n+2P_nO_{3n+1} \quad (I)$$

wherein n is an integer of at least about 17. The physical characteristics of these ammonium polyphosphates and the various processes for preparing them are described, for example, in U.S. Pat. No. 3,397,035 dated Aug. 13, 1968. Water solubility of the polyphosphate is increased as the degree of ammoniation is lowered and as the polymer chain length is decreased.

Especially good results are obtained in the present invention with the use of ammonium polyphosphates of formula (I) given above, having an n value between 1000 and 5000, preferably between 1000 and 3000.

The preferred ammonium polyphosphates to be used in accordance with the present invention are solids and have an apparent density between about 0.4 and 0.9 kg/liter, as compared with other powdered fire-extinguishing agents having an apparent density between about 0.4 and 0.45 kg/liter. A phosphorus content of 31.5±0.5% by weight and a water-soluble content of less than 10% measured in a 10% strength aqueous dispersion at a temperature of 25° C. is advantageous.

The particles are advantageously provided in the form of free-flowing, finely divided particles, (crystals or granules), the average particle size being a maximum of 500 microns, advantageously within the range of from about 0.05 to 500 microns, preferably 1 to 100 microns, most preferably less than about 50 microns. Especially good results are obtained in flooding applications using particle sizes of 1 to 12 microns (average).

The particles of dry powder fire-extinguishing agents are uniformly and homogeneously dispersed in the volatile liquid gel. Any of the known perfluorocarbon, chlorofluorocarbon and hydrofluorocarbon fire-extinguishing gases of low ozone depletion potential may be used as the gellable liquid in compounding the compositions of the invention. Representative of those gases are HFC-23, HFC-31, HFC-32, HFC-124, HFC-125, HFC-134, HFC-134a, HFC-218, HFC-227ea, HFC-318, HFC-236fa and the like (see U.S. Pat. No. 5,185,094 incorporated by reference).

The proportion of volatile liquid in the preferred gel compositions of the invention may range from about 30 to about 70 percent by weight of the total gel composition, preferably 40 to 60 percent. The lower the proportion of volatile liquid, the lower is the potential for toxic gases released by fire exposure. Gelling agents for use in gelling non-aqueous dispersions of dry powdered fire-extinguishing agents in organic liquids are well known and include for example pyrogenic silica (such as the commercially available CAB-O-SIL H5 marketed by G. L. Cabot, Inc., Boston, Mass.; pyrogenic alumina (such as Alan C); carboxymethyl cellulose, carrageenin, polycarboxylated vinyl polymers such as carboxypolymethylene and those described in U.S. Pat. No. 4,652,383, incorporated herein by reference thereto, guar gum and the like. A preferred gelling agent is fumed silica-alumina (Coke® -84; DeGussa, Inc. Teterboro, N.J.).

The gelling agents are present in the preferred compositions of the present invention in an amount sufficient to effect gelation of the liquid ingredients. Advantageously, the proportion of gelling agent used is within the range of from 0.05 to 10 percent by weight of the volatile liquid. Gelation is preferably the formation of a thixotrope, having a yield stress of at least about 200 dynes per $cm^2$. Unexpectedly, we found that when the dry particle ingredients have an average size of from 1 to about 12 microns, the amount of gelling agent required to effect gelation of the liquid ingredient is dramatically reduced, i.e.; requiring about one-tenth the amount needed for compositions containing dry particles of larger particle sizes.

The gelling causes the gas and dry particles to "hang together". As a result, the volatile liquid effectively carries the dry powder ingredients directly to the fire, around corners and through clutter (places where nitrogen gas propelled powder compositions generally cannot be directed).

The HALON type gases have formed relatively stable gel compositions, without the use of stabilizing additives. This is not the case when substituting hydrofluorocarbons and chlorofluorocarbons for HALONS, in gel compositions. Due to the differences in polarity and solvent power, of gelled hydrofluorocarbons or chlorofluorocarbons, the suspended dry particles have a tendency to agglomerate in the gelled, liquefied volatile gas. Agglomeration of the particles can clog the dispensing nozzle, resulting in an ineffective application. To overcome this tendency for particle agglomeration, we have of necessity incorporated into the gel compositions of the invention a surfactant and deflocculant system comprised of a plurality of particular and specified surfactants. The surfactant system stabilizes the gel composition and prevents aggromeration and separation of the solid particles from the dispersion.

The term "surfactant" as used herein is a contraction of "surface-active agent" and is a broadly descriptive term used to describe a chemical compound which is (1) soluble in at least one phase of a system, (2) has an amphipathic structure, (3) the molecules of which form oriented monolayers at phase interfaces, (4) exhibits an equilibrium concentration as a solute at a phase interface, greater than its concentration in the bulk of the solution, (5) forms micelles when the concentration as a solute in solution, exceeds a characteristic limiting value and (6) exhibits some combination of the functional properties of detergency, foaming, wetting, emulsifying, solubilizing and dispersing. The surfactants for combination in the gel carriers of the present invention are chosen for their primary functions as polarization neutralizers, lubricants and wetting agents. In the gelled carrier described herein, the formulation with dry fire extinguisher powders is stable for optimal periods of time, to enhance dispensing of the fire extinguishant and to promote rapid extinguishing of flames.

In a gelled composition of the invention, a non-ionic hydrophilic surfactant is included to assist in stabilizing the dispersion of the dry particles in the gel.

As examples of hydrophilic, non-ionic surfactant, there may be mentioned polyoxyethylene sorbitan fatty acid ester such as polyoxyethylene sorbitan monooleate, polyoxyethylene sorbitan monostearate, or polyoxyethylene sorbitan tetraoleate; polyoxyethylene sorbitol fatty acid ester such as polyoxyethylene sorbitol monolaurate, polyoxyethylene sorbitol monooleate, polyoxyethylene sorbitol pentaoleate, or polyoxyethylene sorbitol monostearate; polyoxyethylene glycerol fatty acid ester such as polyoxyethylene glycerol monostearate, polyoxyethylene glycerol monoisostearate, or polyoxyethylene glycerol triisostearate; polyoxyethylene fatty acid ester such as polyoxyethylene monooleate, polyoxyethylene distearate, polyoxyethylene monodioleate, or ethylene glycol distearate; polyoxyethylene alkyl ether such as polyoxyethylene lauryl ether, polyoxyethylene oleyl ether, polyoxyethylene stearyl ether, polyoxyethylene behenyl ether, polyoxyethylene 2-octyl dodecyl ether, or polyoxyethylene cholestanol ether; polyoxyethylene alkyl phenyl ether such as polyoxyethylene octyl phenyl ether, polyoxyethylene nonyl phenyl ether, or polyoxyethylene dinonyl phenyl ether; Pluronic-type surface-active agent such as Pluronic; polyoxyethylene polyoxypropylene alkyl ether such as polyoxyethylene polyoxypropylene cetyl ether, polyoxyethylene polyoxypropylene 2-decyl tetradecyl ether, polyoxyethylene polyoxypropylene monobutyl ether, polyoxyethylene polyoxypropylene hydrogenated lanolin, or polyoxyethylene polyoxypropylene glycerol ether; tetrapolyoxyethylene tetrapolyoxypropylene -ethylene diamine condensate such as Tetronic; polyoxyethylene castor oil or hardened, castor oil derivatives such as polyoxyethylene castor oil, polyoxyethylene hardened castor oil monoisostearate, polyoxyethylene hardened castor oil triisostearate, polyoxyethylene hardened castor oil monopyroglutamic acid monoisostearic acid diester, or polyoxyethylene hardened castor oil maleic acid; polyoxyethylene bees wax laurin derivatives such as polyoxyethylene sorbitol bees wax; alkanol amide such as coconut oil fatty acid diethanol amide, lauric acid monoethanol amide, or fatty acid isopropanol amide; polyoxyethylalkyl amine, polyoxyethylene fatty acid amide, sucrose fatty acid ester, polyoxyethylene nonyl phenyl formamide condensate, alkyl ethoxy dimethylamine oxide, trioleyl phosphate, and the like.

The non-ionic surfactant is advantageously present in a weight proportion of from about 0.5 to 10 percent by weight of the total weight of gelled composition of the invention, preferably less than 5 percent.

It is also advantageous, when the dry particles to be dispersed in the gel composition are polar materials, to counter the polarity of the particles. This can be accomplished by adding to the compositions a depolarizing proportion of an anionic surfactant. Representative of anionic surfactants are surfactant compounds which contain an organic hydrophobic group containing from about 8 to 26 carbon atoms and preferably from about 10 to 22 carbon atoms in their molecular structure; and at least one water-solubilizing group selected from the group consisting of sulfonate, sulfate and carboxylate so as to form a water-soluble surfactant.

Examples of anionic surfactants include soaps, such as, the water-soluble salts (e.g., the sodium, potassium, ammonium and alkanol-ammonium salts) of higher fatty acids containing from about 8 to 20 carbon atoms.

Other anionic surfactants are the alkane sulfonates including long chain alkane sulfonates and long chain hydroxyalkane sulfonates. Also the sulfated ethoxylated higher fatty alcohols of the formula RO $(C_2H_4O)_mSO_3M$, wherein R is a fatty alkyl of from 10 to 22 carbon atoms, m is from 2 to 6 (preferably having a value from about ⅕ to ½ the number of carbon atoms in R) and M is a solubilizing salt-forming cation, such as an alkali metal, ammonium, lower alkylamino or lower alkanolamino, or higher alkyl benzene sulfonate wherein the higher alkyls of 10 to 15 carbon atoms are present. The proportion of ethylene oxide in the polyethoxylated higher alkanol sulfate is preferably 2 to 5 moles of ethylene oxide groups per mole of anionic surfactant, with three moles being most preferred, especially when the higher alkanol is of 11 to 15 carbon atoms.

Another class of preferred anionic surfactant found useful as a component of the compositions of the invention are the sulfonates of formula:

$$RSO^-_3Na^+$$

wherein R is a hydrocarbyl group. Representative of such sulfonates are sodium xylene sulfonate, sodium lauryl sulfate and the like.

A depolarizing amount of anionic surfactant is generally from about 0.5 to about 10.0 percent by weight of the total weight of the gel composition of the invention.

Minor amounts (0.001 to 0.5 parts by weight of the total gel composition) of film-forming surfactants such as the fluorocarbons described in U.S. Pat. Nos. 2,937,098 and 3,163,547 (incorporated herein by reference thereto) are also used in the gel compositions of the invention. These are generally provided in relatively small proportions as emulsions in alcohols such as isopropyl alcohol. Particularly useful in the present invention are the anionic or cationic perfluorinated surfactants, such as the perfluorinated sulphonic acids having the general formula:

$$C_nF_{2n+1}SO_3H$$

where $C_n$ denotes an aliphatic chain, straight or branched containing from 5 to 20 carbon atoms. The acids are toxic and because of this suitable salts such as the alkali metal salts, for example, the sodium or potassium salts are preferably used. An example of a particularly suitable perfluorinated surfactant is that having the formula $C_8F_{17}SO_3NH_4$. Perfluorinated surfactants are commercially available from the 3M Company, Minneapolis, Minn. The perhalogenated surfactant is usually available in commerce in a mixed aqueous /organic solvent system and may be utilized in that form in the practice of this invention. A preferred emulsion product is Zonyl FSN, a fluorocarbon surfactant composition containing 1.0% active ingredient; E. I. DuPont DeNemours and Company, Wilmington, Del. When added to the compositions of the invention, the solvent is dispersed and the surfactant precipitates as a film, forming on the solid particles dispersed in the gel carrier.

Critical to the compositions of the invention which include the dry powders described above, is the presence of a phosphorus containing antiflocculent, which is compatible with fire-extinguishing agents. Representative Of antiflocculents containing phosphorus are compounds such as the phosphoric acid ester salts like alkylphosphates, alkyl ether phosphates, and alkylallyl ether phosphates.

Preferred phosphorus containing antiflocculents are the acidic phosphorus-containing compounds, for example, the water-soluble di- or polyphosphonic or di- or polyphosphinic acid esters or water-soluble salts thereof. Representative of the phosphonic or phosphinic acid esters or salts thereof are those of the general formulae (II) to (VI) as follows:

$$Y_2—(X)_n \quad \text{(II)}$$

$$[Y(X)_n]_3N \quad \text{(III)}$$

$$[[Y(X)_n]_2N]_2(X)_n \quad \text{(IV)}$$

$$[[Y(X)_n]_2N(X)_n]P \quad \text{(V)}$$

$$[[Y(X)_n]_2N(X)_n]_3N \quad \text{(VI)}$$

where P represents a phosphonic or phosphinic acid radical or water-soluble salt (preferably ammonium) of such a radical;

N represents a nitrogen atom,

X represents the methylene or substituted methylene radical —$CR_2$ or, where $(X_n)$ is directly bonded to 2 nitrogen atoms and n is greater than 1, two adjacent X groups may represent a part of a cycloalkyl, preferably a cyclohexyl, group, n represents a whole number from 1 to 5, R represents —H, —OH or —$(CH_2)_2H$ or part of a shared cycloalkyl group.

Compounds according to the above general formulae (II)–(VI) are widely available commercially usually as solutions, e.g. of 50% to 75% by weight, in water, for example from the Monsanto Company, St. Louis Mo., under the Trade Name Dequest®. Although these compounds are provided in aqueous solution, because limited proportions are used, the overall contribution of water to the total composition of the invention is negligible and the total gel composition is substantially "non-aqueous" in nature.

Specific preferred compounds are:

Formula (II)

1-hydroxyethylidene 1,1-diphosphonic acid (Dequest® 2010) and the tetra sodium salt thereof (Dequest® 2016)

Formula (III)

aminotrimethylene phosphonic acid (Dequest® 2000)

Formula (IV)

ethylenediaminetetra (methylene phosphonic acid) ammonium salt (Dequest® 2042) and the hexamethylenediamine variant of the last compound (Dequest® 2052)

Formula (V)

diethylenetriaminepenta (methylene phosphonic acid) (Dequest® 2060).

Similar products are also available under the Trade Names "Mykon" P060 and "Briquest" APPA 60A.

The phosphonic or phosphinic acid salts are employed in an anti-flocculent proportion, which is generally within the range of from 0.5 to 10 percent by weight of the total gel composition of the invention.

Those skilled in the art will appreciate that ammonium polyphosphate, described above as a preferred dry powder fire-extinguishing agent ingredient for the compositions of the invention are also, inherently, antiflocculents and that function is exploited in the present invention when they are employed as the dry powder fire-extinguishing agent. In other words, when the compositions of the invention include at least 0.5 to 10.0 percent by weight of ammonium polyphosphate particles, the need for an antiflocculent is satisfied.

The preferred compositions of the invention may be containerized within containers having the structural strength for withstanding the superatmospheric pressures developed during storage and ambient use temperatures. Generally, these pressures will be within the range of from about 15 to 250 PSIG at room temperatures. The container loading is facilitated by cooling the compositions of the invention below their critical vapor pressures, during loading.

The container compositions of the invention may also be overpressured to facilitate discharge, with non-flammable gases such as nitrogen, carbon dioxide, helium, argon and like inert gases, using conventional techniques. To facilitate ease of use of the compositions of the invention, the compositions are contained in a flame [or fire] extinguishing system. Such systems may comprise containment means for holding under superatmospheric pressure the compositions and valve means on the containment means for release of the contained compositions from the containment means onto the flame [or fire] to be extinguished. Advantageously, the system is fitted with sensor means for detecting a fire and automatically operating the valve means.

The following examples and preparations describe the manner and process of making and using the invention and set forth the best mode contemplated by the inventors of carrying out the invention but are not to be construed as limiting the invention.

GEL STABILITY STUDIES

A plurality of pressure-resistant, clear glass vessels were provided, each fitted with an aerosol valve (Bespak Company) and a dip tube for containing a series of fire-extinguishing compositions. The compositions were loaded into the vessels under pressure and allowed to stand for at least 36 hours. At the end of this period of time, the pressurized contents of the vessels were discharged by use of an actuator. Weights of the vessels were taken before release of the contents and after release to calculate the percentage of the composition which discharged. The greater the percentage of expulsion, the greater is the stability and effectiveness of the dispersion as an indicator of lack of separation. The composition ingredients and the percentages expelled are given below.

EXAMPLE 1

A composition of the invention is prepared by dispersing 100.4 gms of monoammonium phosphate (MAP) having an average particle size of 30 microns in 120.3 gms of 1,1,1,2-tetrafluoroethane (HFC-134a; gelled with 2.0 gm of fumed silica/alumina (Coke® 84, DeGussa, Inc., Teterboro, N.J., and containing 1.0 gms of polyoxyethylene sorbitol (Tween® 80, ICI, Wilmington, Del.) 0.1 gms of Zonyl® FSN fluorosurfactant, supra., and 2.0 gms of an anti-flocculent (Dequest® 2016; Monsanto Company, St. Louis, Mo.). Upon actuation, 88.4% of the particles are expelled from the container without flow interruption.

EXAMPLE 1-B (Control)

For purposes of comparison, a control composition was prepared as described in Example 1 above, but without addition of the polyoxyethylene sorbitol. Upon actuation, the gel exhibited poor flow and only 72.9% of particle expulsion occurred.

EXAMPLE 1-C (Control)

For purposes of comparison, a control composition was prepared as described in Example 1, supra., but without addition of the Zonyl® FSN fluorosurfactant. Upon actuation, 70.3% expulsion of particles occurred with poor flow.

EXAMPLE 1-D (Control)

For purposes of comparison, a control composition was prepared as described in Example 1, supra., but without addition of the Dequest® 2016. Upon actuation, poor flow occurred, with clumping. The expulsion accounted for 74.7 percent of the particles.

Repeating the general procedure of Example 1, supra., but replacing the HFC 134a as used therein with an equal weight of one of the following volatile gases, trifluoromethane (HFC-23)

pentafluoroethane (HFC-125)

heptafluoropropane (HFC-227ea)

1,1,1,3,3,3-hexafluoropropane (HFC-236fa)

perfluoropropane (FC-218)

perfluorobutane (FC-3-1-10) or trifluoroiodomethane (FIC-1311)

there is obtained a composition of the invention useful to extinguish fires and is equal in flow and stability to the HFC 134a-containing formulation of Example 1, surpa.

EXAMPLE 2

Repeating the procedure of Example 1, supra., but replacing the monoammonium phosphate as used therein with an equal weight of potassium bicarbonate (average particle size 30 micron), a gel composition was obtained which upon actuation released 88.4 percent of the particles with good flow from the container.

EXAMPLE 2-B (CONTROL)

The procedure of Example 2, supra., was repeated except that the polyoxyethylene sorbitol was not added. Upon actuation, 65% of the particles were expelled, with poor flow.

EXAMPLE 2-C (Control)

The procedure of Example 2, supra, was repeated, except that the Dequest® 2016 as used therein was omitted. The expulsion upon actuation accounted for 77.7 percent of the particles with poor flow and clumping.

EXAMPLE 3

Repeating the procedure of Example 1, supra., but replacing the monoammonium phosphate as used therein with an equal weight of ammonium polyphosphate (of formula (I), supra., Phos-Chek® P/30; n=1000 to 3000, Monsanto Company, St. Louis, Mo.) having average particle size of 30 micron and replacing the polyoxyethylene sorbitol as used therein with an equal proportion of ethoxylated/propoxylated $C_8$–$C_{10}$ alcohols (Antarox BL-240; Rhone-Poulenc, Cranbury, N.J.) and omitting the Dequest® 2016 as used therein, there is obtained a gel which expels smoothly (92.8% particle expulsion) from the containing vessel.

The product of Examples 1, 2 and 3 are environmentally safe. The ODP of HFC-134a is zero. The atmospheric lifetime is 15.4 years. The 100-yr $CO_2$ for the global warming potential (GWP) is 1200. The dry chemical component does not affect the atmosphere, other than as a dust. All components are environmentally acceptable for production and use. Since the components do not chemically combine, they separate upon release into their original forms. Therefore, no new chemical compounds are created and there is no environmental impact.

EXAMPLE 4

The procedure of Example 1, supra., was repeated except that the HFC-134a as used therein was replaced with an equal proportion of HFC-125. The gel/particle dispersion obtained is equal in flow and stability to the HFC-134a containing compositions.

STREAMING AGENT EVALUATION

Small-scale streaming tests were performed with 4-inch high 18 in×18 in square pans (2.25ft$^2$). The pans were filled with 1-inch of n-heptane floated on water. A steel structure was fabricated to surround the pan and virtually eliminate any effects caused by the wind. The structure was 16 ft×16 ft×8 ft high. Additionally, a wind curtain was extended 5 feet above the structure to help mitigate effects associated with wind.

An intermediate-scale (32 ft$^2$) pool fire test was also performed. This pool was a circular steel pit with 2 inches of Jet A fuel floating on 10 inches of water. There was a 3 inch "lip" above the fuel surface.

Small-Scale Tests

The extinguisher used for the small-scale tests was fabricated from a stainless steel cylinder having a capacity of 1-gallon. The extinguisher had a valve on one end and a hose on the other. The valve, located on the top of the extinguisher, had a quick-disconnect for filling. A nitrogen hose was attached to the same quick-disconnect to provide for a constant nitrogen overpressure during the test. Connected to the end of the hose was a nozzle assembly taken directly from one of the 1¼ Halon 1211 extinguishers. The flexible hose, which was 2.5 feet in length, made it easy to apply the agent with a consistent sweep rate. The agent could also be applied at the desired angle of attack.

The extinguisher was mounted on a pulley system which was designed to support the extinguisher, yet still allow the firefighter the freedom of movement. The firefighter simply rolled the extinguisher along the pulley system into the desired position for the test. The extinguisher could easily be removed from the pulley system between tests and weighed.

Intermediate-Scale Fire Extinguisher

An Amerex 20-lb Halon 1211 fire extinguisher was used for the intermediate-scale tests.

Five different sizes of nozzles were used during the small-scale testing. The orifice sizes were as follows: 0.067, 0.076, 0.082, 0.090, and 0.098 inches. The 0.082 and 0.090 nozzles were fabricated by drilling out the center of a 0.067 nozzle to obtain the desired bore.

The test procedures were basically the same as for the small-scale tests. In an effort to keep the technique consistent, the same firefighter was used for all of the tests. The test procedures are summarized below:

1. The extinguisher was weighted empty to establish a tare weight.
2. The extinguisher was filed with the desired amount of powder (APP or MAP) and the gaseous agent (HFC-125 or HFC-134a) the gelling agent and surfactant system and shaken vigorously by hand until the "gelling" of the agent could be felt.

3. The extinguisher was pressurized with nitrogen.
4. The extinguisher was weighted to establish the initial weight of the extinguisher and the agent blend.
5. The extinguisher was attached to the pulley system and the nitrogen overpressure hose was connected to the extinguisher.
6. The fire pan was filled with 3-inches of water and 1-inch of heptane.
7. The fire was ignited and a 60 sec preburn was established.
8. The agent was applied to the fire by squeezing the nozzle fully and producing a sweeping motion across the fire. The agent was initially applied to the front of the pan in an effort to push the fire to the back of the pan until extinguishment was achieved. Every effort was made to keep the agent on the fire and minimize overspray.
9. The time from agent application to extinguishment was recorded with a stopwatch.
10. The extinguisher was weighed to determine the amount of agent dispensed.

The above procedures were also used during the intermediate-scale (32ft$^2$) tests; however, the extinguisher did not have a constant nitrogen overpressure.

SMALL-SCALE TEST RESULTS

The compositions of the invention were effective in extinguishing the fires, particularly the APP/HFC-134a blend. The test results are shown in Table 1, below. The APP/134a blend (weight ratio of 45% particles:55% liquid) had a minimum weight to extinguish of 0.30 lb. The extinguishment time was 1.65 sec.

TABLE I

| Agent | Optimum Flowrate, (lbs/sec) | Ext. Time, (sec) | Agent Used (lb) |
|---|---|---|---|
| Halon 1211 (Control) | 0.18 | 1.6 | 0.28 |
| 45% APP/55%134a | 0.18 | 1.6 | 0.30 |
| 45% MAP/55%134a | 0.15 | 3.1 | 0.45 |

Test Summaries

Halon 1211 (Control)

Ten tests were performed with Halon 1211 on the 2.25 ft$^2$ fires. The fire was easily extinguished in each of these tests. The quickest extinguishment time was 1.6 sec, in which 0.28 lb of agent was consumed. The flowrate was 0.18 lbs/sec.

HFC-134a (Control)

Three tests were performed with the HFC-134a. The agent was applied to the 2.25 ft$^2$ fire and extinguishment was achieved in one of the tests. It took however, 29 sec, and 4.52 lbs of agent was required. The flowrate was 0.16 lbs/sec. The next test was performed with a much higher flowrate (0.29 lbs/sec.). The agent was extremely ineffective at this flowrate. The agent appeared to blow right through the fire, and was unable to push the fire to the back of the pan. A total of 5.46 lbs. of agent was used in this test. The flowrate was lowered for the next test, down to 0.18 lbs/sec. The agent performed similarly to the first test, but extinguishment was not achieved after 28 sec had elapsed and 5.2 lbs. of agent had been used.

45% APP/55% 134a (Invention)

Nine tests were performed with this blend. The blend appeared to be extremely effective. The fire was extinguished very quickly, and rather easily in the tests. The quickest extinguishment time was 1.65 sec in which 0.30 lb. of agent was consumed. The corresponding flowrate was 0.18 lbs./sec.

45% MAP/55% 134a (Invention)

Six test were performed with this blend. The blend was effective, but not nearly as effective as the APP blend. The quickest extinguishment time was 3.1 seconds in which 0.45 lb. of agent was consumed. The flowrate was 0.15 lbs/sec.

TOTAL-FLOOD EVALUATION

The fire tests used to evaluate the total flood extinguishment effectiveness of the products included Class 1 wood cribs (½ of a 1A crib) and Class B pool fires. The Class B fuel was n-heptane floated on water in various circular pans. Approximately ½ in of fuel was floated on 2.5 in of water. The water was required to decrease pan warpage. The circular pan sizes were ¼ in steel, 8.5-in diameter (0.4 ft$^2$, 35 Kw) and 1.33-ft diameter (1.4 ft$^2$, 209 Kw) all 4 in deep and corresponding to fire heat release rate to test chamber volume ratios of 1.9 and 11.4 Kw/m$^3$ (0.62 and 2.15 ft$^2$/1000 ft$^3$), respectively.

The blends tested were based on a percent mass composition. Several discharge cylinders were used. A particular cylinder was chosen based upon the total charge weight and desired cylinder fill ratio. The cylinder was weighed so that a tare weight was obtained prior to filling. The desired weight of the composition for testing was added to the cylinder. The halocarbon liquid agent was added last to the cylinder by weight to the desired mass ratio and then the cylinder was pressurized with nitrogen gas. A total weight was determined. The total weight included the nitrogen overpressure. The cylinder with the powder, the halocarbon agent, gelling agent, surfactant system and nitrogen was then shaken (mixed) until the mixture blended (gelled) together. This gelling effect was noticeable as the cylinder was being shaken. The cylinder was then attached to the discharge system. After a one minute pre-burn the agent was discharged into the chamber.

After the discharge was completed the cylinder post weight was measured to determine the amount of powder left in the cylinder (all of the gaseous agent was discharged).

From previous testing done, a composition of 45 percent powder to 55 percent halocarbon agent by mass was first tried. The first test conducted was of the 45 percent APP (7 micron average particle size) powder and 55 percent HFC-134a by mass to determine if the agent would flow through the piping system. The doors on the test chamber were left open and the agent was observed being expelled through the agent discharge pipe network. The fire was 35 kW and was extinguished prior to the end of the discharge. The test was considered to be a success. The agent weight was felt to be excessive since the fire was extinguished during the agent discharge and the test chamber doors were open.

The next step in the testing was to find the lower bounds, by mass, needed to extinguish the fire. The powder mass in the blend was lowered; however, the percent composition was kept at 45 percent by mass composition. The test chamber doors were kept closed throughout the rest of the testing. Tell tale fires consisting of 2 inch diameter cups 4 inches tall with 2 in heptane were placed in all eight corners, top and bottom of the test chamber to determine the agent mixing characteristics in the test chamber. The total agent weight was lowered to approximately two pounds (powder plus halocarbon agent).

Fire Extinguishing Results

There were several total-flood tests performed with the compositions of the invention. Table II, below summarizes the results.

The fire extinguishing effectiveness was equal to or better than the existing Halons in total flooding and streaming applications.

TABLE II

| Test No. | APP Weight lbs. | HFC-134a Weight lbs. | Discharge Time, sec | Weight Agent Used, lbs. | Actual Powder Conc. g/m$^3$ | Actual Total Agent Conc g/m$^3$ | Calc. Gaseous Agent Conc. % | Center Fire Out, (sec) |
|---|---|---|---|---|---|---|---|---|
| 1 | 4.50 | 5.50 | 4.5 | 9.20 | 80 | 229 | 4.0 | yes |
| 2 | 6.10 | 9.00 | 6.0 | 13.40 | 109 | 333 | 6.5 | 8 |
| 3 | 5.50 | 8.00 | 6.5 | 13.57 | 135 | 337 | 5.8 | 5.5 |
| 4 | 5.50 | 8.00 | | | | | | 6 |
| 5 | 5.00 | 8.60 | | | | | | 4 |
| 6 | 4.50 | 6.50 | 6.0 | 12.46 | 96 | 310 | 6.2 | 4 |
| 7 | 4.00 | 5.80 | | | | | | 6 |
| 8 | 3.50 | 5.30 | | | | | | 7 |
| 9 | 3.00 | 4.50 | | | | | | 7 |
| 10 | 3.50 | 5.25 | 6.0 | 8.20 | 67 | 204 | 3.8 | 7 |
| 11 | 4.00 | 6.00 | 7.2 | 10.00 | 92 | 248 | 3.8 | 7 |
| 12 | 4.00 | 6.00 | 5.0 | 8.40 | 45 | 209 | 4.3 | 7 |

It was previously appreciated that very fine particles of fire-extinguishing powders, that is, particles in the micron size, are highly effective in extinguishing fires; see U.S. Pat. No. 4,234,432. However, such small particle sizes cause difficulties in terms of the discharge of the powders from dissemination apparatus. The finely divided powder particles tend to agglomerate and form masses, which clog the nozzles, valves and other parts of the apparatus, especially after sitting for a period of time. The patentee in U.S. Pat. No. 4,234,432 approached the problem by providing the particles in a bimodal particle size distribution, wherein the larger powder particles had an average approximate maximum dimension of about 4 to about 10 times greater than the average approximate maximum dimension of the smaller powder particles. This is a manufacturing problem, requiring the obtaining and mixing of the bimodal particles. We have found that employing the surfactant system described above and as employed to prepare the gelled compositions of the present invention, less than 10 micron sized particles (average diameter) may be used to obtain shelf-stable compositions for effective use in fire extinguishers.

EXAMPLE 5

A composition of the invention was prepared following the general procedure of Example 1, supra., mixing the following ingredients.

100 gms of ammonium polyphosphate (Phos-Chek®. supra.) having an average particle size of 7 micron.

125 gms of HFC 134a, supra.

0.2 gms of Zonyl® FSN, supra.

1.0 gms of Antarox® BL-240, supra.

0.5 gms of Coke® 84, supra., gelling agent.

Upon actuation, 92.7 percent of the particle expelled in a homogeneous, uninterrupted flow.

EXAMPLE 6

To evaluate the comparative fire-extinguishing effect of the 30 micron (average) sized particles used in the composition of Example 4, supra., against the 7 micron (average) sized particles used in the composition of Example 5, supra. Testing in a flood application was conducted using 1000 ml. of heptane fuel floated on 1000 ml. of water in a 5.5 cubic meter box. On average, 460 gms of the composition of Example 4 (30 micron particles) was required to effect flame extinction, while only 375 gms. of the composition of Example 5 (7 micron particles) was required.

What is claimed is:

1. A substantially non-aqueous, flame-extinguishing gel composition of low ozone depletion potential, which comprises;

a plurality of particles of a dry powder fire-extinguishing agent, dispersed in a gel, comprised of:

30 to 70 percent by weight of the total gel composition of a liquefied fire-extinguishing, gas of low ozone depletion potential;

0.5 to 10 percent by weight of the total gel composition of a hydrophilic, non-ionic surfactant;

0.001 to 0.5 parts by weight of the total gel composition of a film-forming fluorocarbon surfactant of the formula:

$C_nF_{2n+1}SO_3H$ wherein n is from 5 to 20, and the alkali metal salts thereof; and 5 to 10 percent by weight of the total gel composition of a phosphorus-containing antiflocculent.

2. The composition of claim 1 wherein the particles are selected from the group consisting of ammonium sulfate, sodium carbonate, potassium carbonate, sodium bicarbonate, potassium bicarbonate, ammonium borate, potassium borate, sodium borate, sodium sulfate, sodium phosphate, sodium polyphosphate, sodium chloride, potassium chloride, ammonium bromide, monoammonium phosphate, diammonium phosphate, and ammonium polyphosphate.

3. The composition of claim 1 wherein the particles have maximum average particle sizes of 500 microns.

4. The composition of claim 3 wherein the average particle sizes are less than about 50 microns.

5. The composition of claim 4 wherein the average particle sizes are about 30 microns.

6. The composition of claim 1 wherein the p article size averages 1 to 12 microns.

7. The composition of claim 1 wherein the particles are particles of ammonium polyphosphate.

8. The composition of claim 7 wherein the ammonium polyphosphate has the general formula:

$$(NH_4)_n+2P_nO_{3n+1} \quad (I)$$

wherein n is an integer of at least about 17.

9. The composition of claim 8 wherein n has a value of between 1000 and 5000.

10. The composition of claim 8 wherein n has a value of between about 1000 and 3000.

11. The composition of claim 10 wherein the average particle size is about 30 microns.

12. The composition of claim 1 wherein the gas is selected from the group consisting of a perfluorocarbon, a chlorofluorocarbon, an iodofluorocarbon and a hydrofluorocarbon.

13. The composition of claim 12 wherein the gas is 1,1,1,2,-tetrafluoroethane.

14. The composition of claim 12 wherein the gas is pentafluoroethane.

15. The composition of claim 12 wherein the gas is trifluoroiodomethane.

16. The composition of claim 1 wherein the proportion is 40 to 60 percent.

17. The composition of claim 1 wherein the gel is formed by a gelling agent selected from the group consisting of pyrogenic silica, pyrogenic alumina, carboxymethyl cellulose, carrageenin, polycarboxylated vinyl polymers and guar gum.

18. The composition of claim 17 wherein the gelling agent selected is fumed silica-alumina.

19. The composition of claim 1 wherein the phosphorous containing antiflocculent is selected from the group consisting of:

$$Y_2—(X)_n \quad (II)$$

$$[Y(X)_n]_3N \quad (III)$$

$$[[Y(X)_n]_2N(X)_n]Y \quad (IV)$$

$$[[Y(X)_n]_2N(X)_n]Y \quad (V)$$

and $$[[Y(X)_n]_2N(X)_n]_3N \quad (VI)$$

where Y represents a phosphonic or phosphinic acid radical or water-soluble salt of such a radical;

N represents a nitrogen atom,

X represents the methylene or substituted, methylene radical —$CR_2$ or, where $(X)_n$ is directly bonded to 2 nitrogen atoms and n is greater than 1, two adjacent X groups may represent a part of a cycloalkyl, n represents a whole number from 1 to 5; and R represents —H, —OH or —$(CH_2)_2H$.

20. The composition of claim 1 wherein the phosphorus containing antiflocculent is ammonium polyphosphate.

21. The composition of claim 1 where in the non-ionic surfactant is polyoxyethylene sorbitol.

22. The composition of claim 1 which further comprises an anionic surfactant.

* * * * *

UNITED STATES PATENT AND TRADEMARK OFFICE

CERTIFICATE OF CORRECTION

PATENT NO. : 5,833,874
APPLICATION NO. : 08/567631
DATED : November 10, 1998
INVENTOR(S) : Stewart et al.

It is certified that error appears in the above-identified patent and that said Letters Patent is hereby corrected as shown below:

In Column 16:

Claim 19 Element (IV) the sixth line down and element (V) the eighth line down should read:

-- $[[Y(X)_n]_2N]_2(X)_n$ (IV) --

-- $[[Y(X)_n]_2N](X)_n]P$ (V) --

Signed and Sealed this

Twenty-ninth Day of May, 2007

JON W. DUDAS
*Director of the United States Patent and Trademark Office*